United States Patent [19]

Saraisky

[11] 4,372,500

[45] Feb. 8, 1983

[54] INSERTS FOR USE WITH WEB DISPENSING MEANS

[76] Inventor: Alfred Saraisky, 27 Cayuga Ave., Oakland, N.J. 07436

[21] Appl. No.: 235,669

[22] Filed: Feb. 18, 1981

[51] Int. Cl.[3] ..... B65H 79/02

[52] U.S. Cl. ..... 242/55; 53/465; 242/1; 242/55.2; 242/68.6

[58] Field of Search ..... 242/68.6, 55, 96, 85, 242/68, 68.4, 68.5, 55.2, 55.54; 53/465, 139.3, 203, 218, 219

[56] References Cited

U.S. PATENT DOCUMENTS

| | | | |
|---|---|---|---|
| Re. 30,168 | 12/1979 | Mason | 206/413 |
| 1,581,279 | 4/1926 | Marvin et al. | 242/68.6 |
| 1,614,112 | 1/1927 | Fisher | 242/55.2 X |
| 2,021,417 | 11/1935 | Hoffman | 242/55.2 |
| 2,254,735 | 9/1941 | Fischer | 242/55.2 |
| 2,269,939 | 1/1942 | Janisch | 206/59 |
| 2,699,903 | 1/1955 | Montgomery | 242/68.1 X |
| 2,928,619 | 3/1960 | Burton et al. | 242/68.1 |
| 3,038,928 | 4/1963 | Voissem | 242/68.6 |
| 3,521,833 | 7/1970 | Ridgeway | 242/118.61 |
| 3,627,220 | 12/1971 | Vogel | 242/68.6 |
| 3,713,601 | 1/1973 | Buhrman et al. | 242/68.6 |
| 3,763,619 | 10/1973 | Stone | 53/3 |
| 3,840,194 | 10/1974 | Vetter | 242/68.6 |
| 4,174,077 | 12/1979 | Charles | 242/68.6 |

FOREIGN PATENT DOCUMENTS

| | | | |
|---|---|---|---|
| 769574 | 10/1967 | Canada | 242/68.6 |

*Primary Examiner*—Stanley N. Gilreath
*Attorney, Agent, or Firm*—Weinstein & Sutton

[57] ABSTRACT

Hat-like inserts for use with supply rolls comprised of a hollow cylindrical core having an elongated web of indeterminate length wrapped about said core. The hat-like inserts have a slightly tapered, generally cylindrical shaped side wall terminating at the narrow diameter end in an integral closed end surface and being opened at the wider diameter end thereof and having an integral continuous flange encircling said open end and extending radially outward therefrom. The inserts are pressed into opposing ends of the hollow core with said flanges overlying at least the adjacent end of said core and preferably a portion of the end of the rolled up web. A curvature provided in the region where the open end of said cylindrical side wall joins said flange maintains the flange a spaced distance from at least the adjacent core to prevent surface contact therebetween and thereby reduce frictional drag. Outwardly projecting ribs are provided about said cylindrical side wall to minimize surface contact between the insert and the interior periphery of said core. Inwardly directed ribs are provided along the side wall of said insert which, together with the outwardly projecting ribs, facilitate gripping of the insert by the fingers of an operator. The insert is preferably made of a suitable plastic material having a low coefficient of sliding friction to permit the core to rotate relative to the hand held inserts facilitating the feeding and dispensing of the web of wrapping material. The supply roll of wrapping material may be stably stood on either one of its ends without removing the inserts, said flanges preventing the edge of the web from being damaged.

18 Claims, 8 Drawing Figures

INSERTS FOR USE WITH WEB DISPENSING MEANS

BACKGROUND OF THE INVENTION

To facilitate the neat, orderly and efficient storage and shipping of merchandise, which may typically be packaged in shipping cartons, the merchandise is palletized, i.e. a predetermined quantity of shipping cartons containing the merchandise are arranged upon a pallet which facilitates movement and storage of the merchandise, typically by materials handling euipment such as for example, a fork-lift truck. In addition to palletizing merchandise, it is often helpful and even necessary to wrap the palletized merchandise to prevent its being damaged by moisture or rain and to prevent it from becoming dusty, dirty or otherwise degraded due to the presence of contaminants within the area occupied by the merchandise when it is being shipped and/or stored.

One conventional technique for protecting palletized merchandise is to wrap a web of clear plastic film around the palletized merchandise. This is accomplished through the use of a roll of plastic film whose free end is tucked into a starting point of the palletized merchandise. The operator then walks about the pallet dispensing the web from the supply roll by unrolling the web. The web is held by the operator by means of a holding apparatus, which is conventionally comprised of a supporting rotatable spindle inserted through the core of the supply roll and being rotatable relative to a pair of handles on which the rotatable spindle is freewheelingly mounted. These devices are expensive, difficult to handle and further add a significant amount of weight to the already heavy roll, making the wrapping operation complex and tedious. In addition the holding assembly is easily damaged due to the rough handling normally encountered, requiring frequent and expensive repairs. In addition, it is not possible to stand the supply roll up on its end without removing the conventional holding device thus adding to the number of steps and complexity of the wrapping operation.

Due to the awkwardness of the aforementioned conventional holding assembly, operators quite frequently dispense completely with its use and hold the supply roll in their bare hands. Since the supply roll rotates relative to the fingers of the operator as the web is being dispensed and wrapped about the pallet, the operators subject their hands and fingers to paper burns and paper cuts. In addition, it is a practical impossibility for the operator to prevent his hands from engaging the edges of the web which causes inadvertent and undesirable tearing and/or splitting of the web, which is to be avoided since it complicates the dispensing the wrapping operation.

FIELD OF THE INVENTION

The present invention relates to apparatus for use in dispensing elongated webs and the like and more particularly to novel inserts for use with such web supply rolls to facilitate dispensing of the web and to protect both the web and the operator.

BRIEF DESCRIPTION OF THE INVENTION

The present invention is characterized by comprising inserts which avoid all of the disadvantages of the prior art supply roll holding device and which protect the operator from injury and protect the web from being cut, split or contaminated, said inserts being comprised of a suitable plastic material which undergoes preferably a vacuum forming operation to form a hat-like insert having a slightly tapering generally cylindrical-shaped side wall defining a hollow interior. The smaller diameter end is closed by an end surface integrally joined thereto. The larger diameter end is open and has a brim-like flange extending radially outward therefrom. The flange is joined to the side wall by a curved annular-shaped joining portion arranged between the open end of the cylindrical side wall and the inner end of the annular flange to maintain the flange a spaced distance from the adjacent end of said supply roll. The flange is adapted to overlie at least the end of the supply roll core and preferably at least a portion of the end of the supply roll web wrapped about said core.

The tapered configuration of the cylindrical portion enables nesting and stacking of the hat-like inserts.

Outwardly projecting ribs extending about the cylindrical side wall minimize surface engagement between the side wall of the hat-like insert and the interior periphery of the core of the supply roll.

The interior periphery of the insert is grooved to facilitate gripping by the fingers of the operator during a dispensing and wrapping operation. The surface of the insert is provided with a smooth finish and is formed of a plastic material having a low coefficient of sliding friction.

In use, an insert is pressed into each end of the supply roll hollow core. The operator places one or more fingers of each hand into each insert, holding the inserts as the plastic sheet is wrapped about the merchandise on the pallet, causing the web of wrapping material and the core to rotate relative to the inserts. The side wall and brim portion of the inserts prevent the operator's fingers and hand from engaging the core and the wrapping film, protecting the operator from being cut by the supply roll or from experiencing a burn due to the supply roll rubbing against the operator's fingers and/or hand.

The supply roll may be stood upon its end without removing the inserts and stably remain in this position. The inserts are inexpensive and extremely light-weight, adding an insignificant amount of weight to the supply roll thus significantly reducing the amount of fatigue and strain experienced by the operator in the performance of repeated wrapping operations.

OBJECTS OF THE INVENTION AND A BRIEF DESCRIPTION OF THE FIGURES

It is therefore one object of the present invention to provide novel inserts for use with wrapping film supply rolls and the like for insertion into the ends of the supply rolls to facilitate the dispensing of the web of wrapping material and for protecting the web of wrapping material and the fingers of the operator during the dispensing operation while permitting substantially free rotation of the supply roll relative to the inserts as the web material is being dispensed.

Still another object of the present invention is to provide novel inserts for use in dispensing wrapping material in the form of an elongated web from a supply roll, said inserts being inexpensive and light in weight and having a low coefficient of sliding friction to facilitate relative sliding movement between the inserts and the supply roll core into which the inserts are positioned.

Still another object of the present invention is to provide novel inserts for use in dispensing wrapping material from a supply roll wherein said inserts are provided with integrally formed means for reducing the frictional engagement between the inserts and the supply roll to a practical minimum.

The above as well as other objects of the present invention wil become apparent when reading the accompanying description and drawing, in which.

Figure 1:
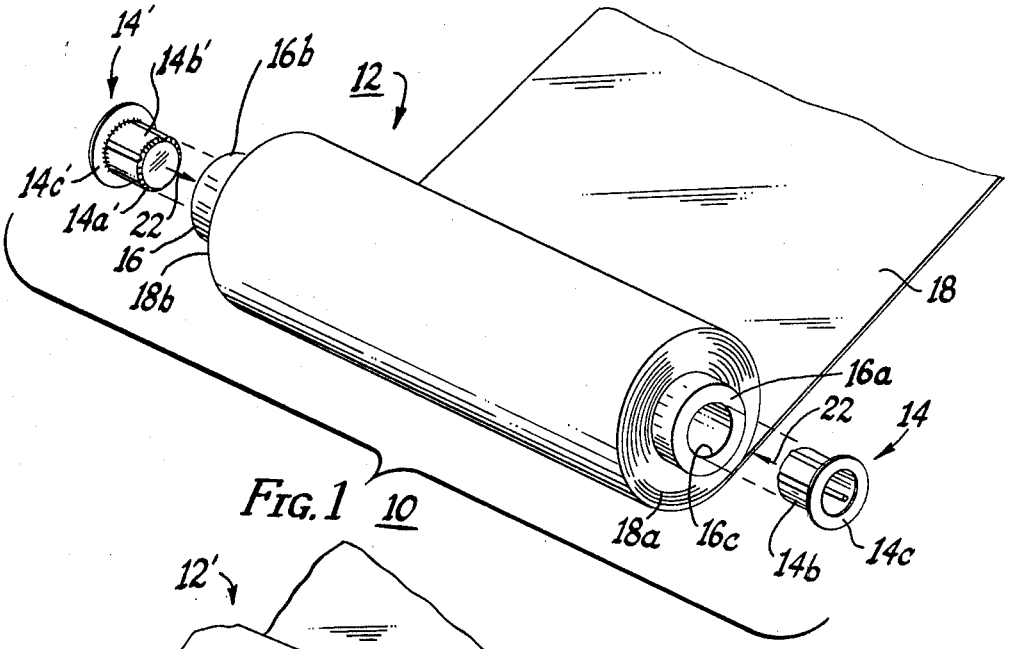
FIG. 1 is an exploded perspective view showing inserts embodying the principles of the present invention and showing the manner in which they may be employed with one type of supply roll of wrapping film.
Figure 2:
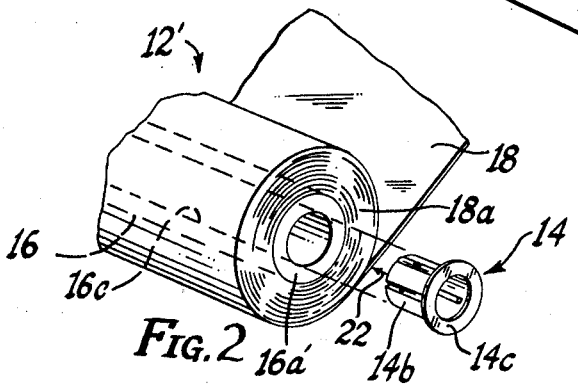
FIG. 2 shows an exploded partial perspective view of an insert and the manner in which the insert may be employed with a supply roll different from that shown in FIG. 1.
Figure 3A:
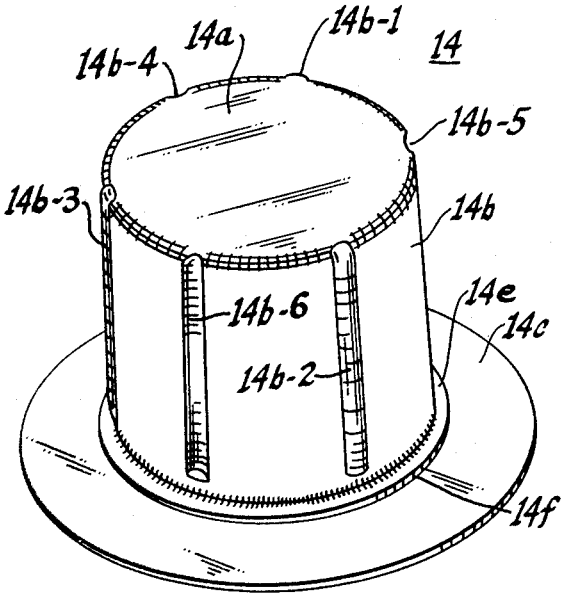

FIG. 3*a* shows an enlarged top perspective view of the insert of FIGS. 1 and 2.

Figure 3B:
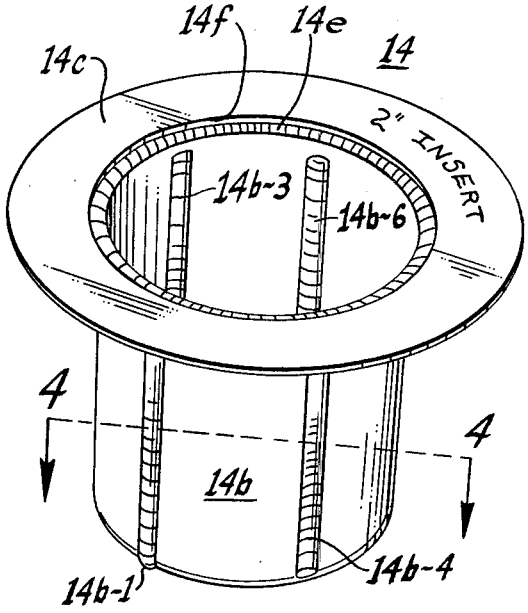

FIG. 3*b* shows an enlarged bottom perspective view of the insert of FIG. 3*a*.

Figure 4:
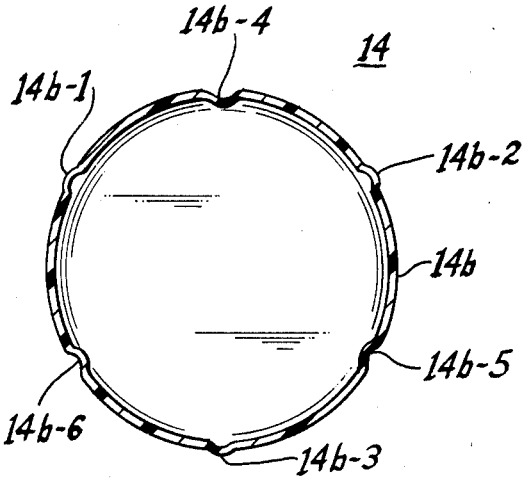

FIG. 4 shows a sectional view of the insert of FIG. 3*b* looking in the direction of arrows 4—4.

Figure 4A:
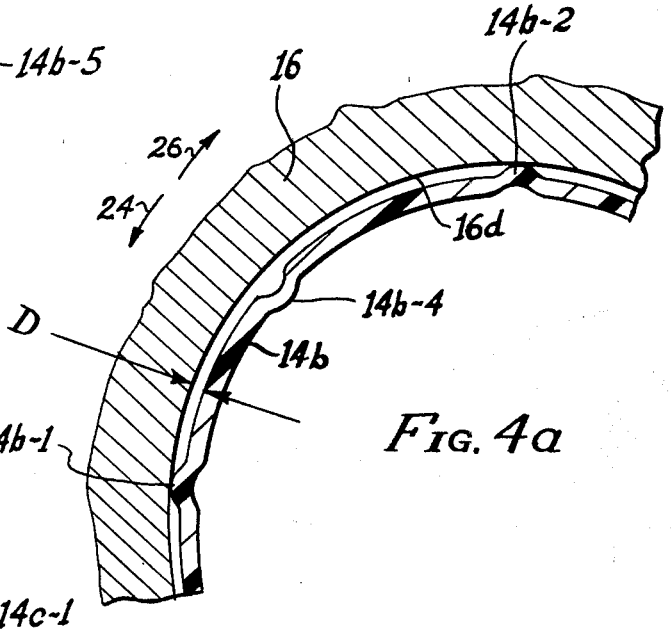

FIG. 4*a* shows an enlarged partial cross-section of an insert and showing the manner in which the insert is positioned within the interior of a supply roll of the type of either FIG. 1 or FIG. 2.

Figure 5:
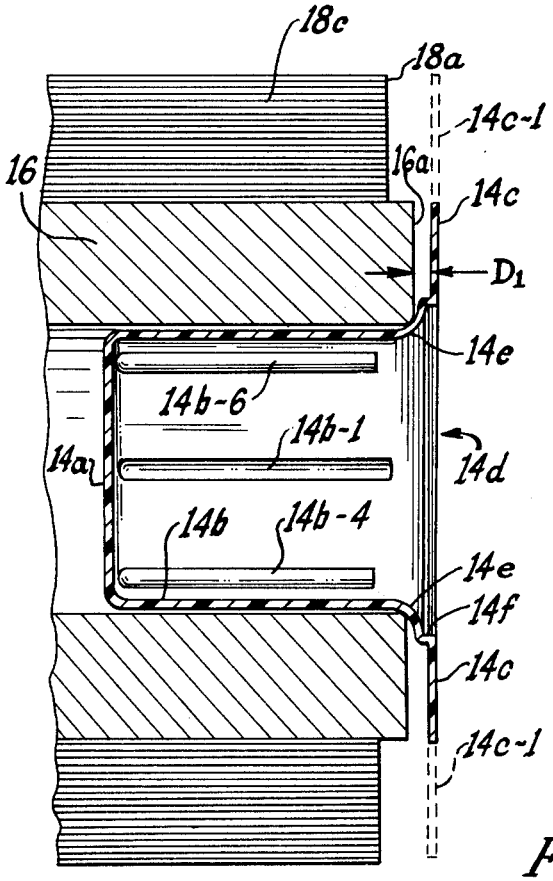

FIG. 5 shows a sectional view taken along a diameter of a supply roll and showing the manner in which an insert is arranged therein.

Figure 6:
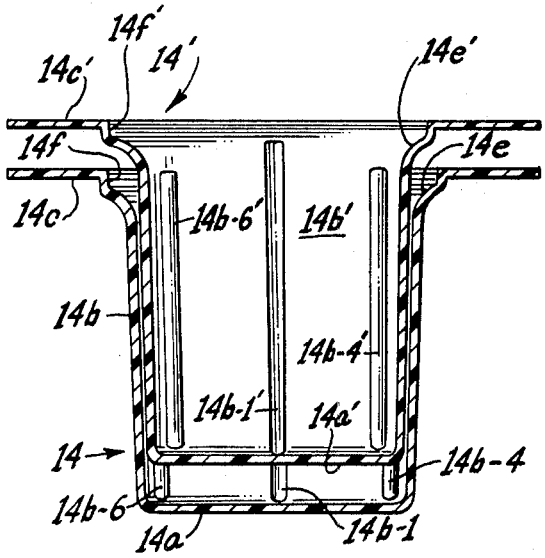

FIG. 6 is a sectional view taken along the diameter of an insert and showing the manner in which the inserts may be nested and stacked.

DETAILED DESCRIPTION OF THE INVENTION

FIG. 1 shows an exploded arrangement 10 showing a supply roll 12 and a pair of inserts 14, 14' adapted for insertion into the supply roll 12 to facilitate a dispensing and wrapping operation.

The supply roll 12 is comprised of a hollow cylinder 16 preferably formed of a rigid and yet relatively lightweight material such as cardboard or stiff paperboard. An elongated web 18 of indeterminate length is wrapped about cylinder 16. The web may for example be a thin gauge transparent plastic film suitable for wrapping. Conventional film 18 in widespread use includes, for example, low density polyethylene film and PVC film. In the embodiment 10 of FIG. 1, the ends 16*a* and 16*b* of cylinder 16 extend beyond the respective ends 18*a* and 18*b* of the web 18.

The interior 16*c* of cylinder 16 is hollow throughout the entire length of the cylinder. The inserts 14 and 14' are inserted into the opposite ends of cylinder 16 by pressing the inserts 14, 14' into the interior 16*c* in the directions shown by arrows 22, 22.

Since the inserts 14 and 14' are identical to one another, only insert 14 will be described herein in detail for purposes of simplicity. Noting especially FIGS. 3*a*, 3*b* and 4, insert 14 can be seen to be comprised of a substantially cylindrical-shaped side wall 14*b* having a slight taper to permit nesting and stacking as will be more fully described. The narrow diameter end is closed by integral end surface 14*a*. If desired end surface 14*a* can have an opening near the center. The larger diameter end of side wall 14*b* is open and is integrally joined to a brim-like annular shaped flange 14*c* which completely encircles side wall 14*b*. The open end 14*d* of side wall 14*b* is joined to flange 14*c* by a curved portion 14*e* having a first smaller diameter end thereof joined to side wall 14*b* and curving outwardly and away from side wall 14*b* and merging with a short, integral annular shaped arm portion 14*f* of flange 14*c* at its larger diameter end. Annular arm portion 14*f* cooperates with flange 14*c* to collectively define an L-shaped configuration. The left-hand end of portion 14*f* (relative to FIG. 5) is integrally joined to curved portion 14*e*, as shown best in FIG. 5.

The insert 14 is preferably produced through a vacuum forming technique, although injection molding, stamping or any other technique may be employed, if desired. The insert is preferably formed of a plastic material such as for example styrene or rubber modified styrene, which materials have the characteristics of providing an insert which, although it is of relatively thin gauge, is light-weight and quite durable and has a low coefficient of sliding friction. The thickness range of the insert is preferably between 0.010 and 0.070 inches, although a thinner or thicker insert may be provided if desired. Preferably the insert has a thickness of between 0.035 and 0.045 inches. In addition, other plastic materials may be employed, such as for example polyethylene or urethane, or any plastic material exhibiting characteristics similar to those set forth above.

Insert 14 is formed so that its side wall 14*b* is provided with a plurality of undulations which undulations are divided into a first group 14*b*-1 through 14*b*-3 which are arranged at 120° intervals about side wall 14*b* in the embodiment of FIG. 4 and which define outwardly directed projections in the form of elongated ribs extending along the exterior surface of side wall 14*b*. The undulations 14*b*-1 through 14*b*-3 also form elongated grooves having semi-circular shaped cross-sections along the interior surface of side wall 14*b*.

The second group of undulations 14*b*-4 through 14*b*-6 form inwardly directed projections along the interior surface of side wall 14*b* defining elongated ribs arranged at 120° intervals relative to one another. The group of undulations 14*b*-4 through 14*b*-6 form shallow semi-circular shaped recesses along the exterior surface of side wall 14*b*.

As was described hereinabove, each insert 14 is pressed into an end of cylinder 16. FIG. 5 shows a typical insert 14 pressed into the interior opening 16*c* of cylinder 16 to occupy the operative position of FIG. 5. In this position, the undulations 14*b*-1 through 14*b*-3 make sliding engagement with the interior surface 16*d* of cylinder 16 as shown best in FIG. 4*a*. FIG. 4*a* shows only two of said undulations 14*b*-1 and 14*b*-2 for purposes of simplicity.

As shown in FIG. 4*a*, the outermost surface portions of undulations 14*b*-1 and 14*b*-2 engage the interior periphery of cylinder 16 while the major portion of the periphery of side wall 14*b* between said undulations is spaced from the interior surface 16*d* by a gap distance D. Obviously, the groove formed on the outer periphery of side wall 14*b* by undulations 14*b*-4 lies a still further distance from surface 16*d* of cylinder 16.

In operation, the inserts 14 and 14' (see FIG. 1) may be considered as remaining stationary while the wrapping film 18 and cylinder 16 experience movement relative thereto. In accordance with FIG. 4*a*, cylinder 16 may be moved, for example either in the direcion shown by arrow 24 or in the reverse direction shown by arrow 26, while side wall 14*b* (i.e. insert 14) remains substantially stationary relative to cylinder 16. As can clearly be seen from FIG. 4*a*, the amount of surface contact between the interior surface 16*d* and the outermost surface portions of undulations 14*b*-1 through 14*b*-3 is minimum. Air trapped within the hollow region between interior surface 16*d* and the exterior surface of a side wall 14*b* also passes through the surface contact region between surface 16*d* and undulations 14*b*-1 and 14*b*-2 to provide a film of air upon which the cylinder 16 "rides" relative to the side wall 14*b* of insert 14 whereby side wall 14*b* exerts minimum drag upon cylinder 16. In addition thereto, as was mentioned hereinabove, the side wall 14*b* is slightly tapered, further reducing engagement between interior periphery 16*d* of cylinder 16 and the exterior periphery of side wall 14*b*. Since insert 14 is made of a plastic material having a very low coefficient of sliding friction and further since insert 14 is formed of relatively thin gauge plastic, the drag imposed upon cylinder 16 by insert 14 is quite small.

Considering FIG. 4 it can clearly be seen that both the inwardly directed projections formed by undulations 14*b*-4 through 14*b*-6 and the recesses formed by undulations 14*b*-1 through 14*b*-3 within the interior of sidewall 14*b* serve as gripping means to facilitate gripping of the interior of the insert 14 by the fingers of the operator, enabling the operator to hold inserts 14, 14' while the wrapping film 18 is being dispensed and wrapped about an object. As was mentioned hereinabove, inserts 14, 14' are extremely thin and are also made of extremely light-weight plastic so that they add a negligible amount of weight to the supply roll 12 which is clearly a significant difference over the bulky and heavy dispensing assemblies presently in use.

Considering FIG. 5, it can be seen that when the insert 14 is pressed into opening 16*c* at end 16*a* of cylinder 16, the curved portion 14*e* engages the vertex 16*d* formed by the inner circular edge of cylinder 16. Curved portion 14*e*, together with straight arm portion 14*f* serves to maintain brim-like flange 14*c* a spaced distance D1 from the right hand end 16*a* of cylinder 16 thus preventing sliding engagement therebetween and further reducing the frictional drag imposed upon cylinder 16 by insert 14 to a practical minimum. Brim-like flange 14*c* overlies at least the end portion 16*a* of cylinder 16 and may, if desired, extend still further in the outward radial direction as shown by dotted flange extension 14*c*-1 in order to overlie at least a portion of the end 18*a* of the roll portion 18*c* formed by the film 18 wound about cylinder 16 and which has yet to be dispensed from supply roll 12.

Brim-like flange 14*c* protects the operator from abrasive type burns or cuts by preventing the operator's fingers from engaging end 16*a* of cylinder 16. Brim 14*c*, when it overlies the end 18*a* of film 18 also protects the operator's fingers from engaging the plastic film 18 and likewise protects the operator from suffering a cut or an abrasive type of burn. In addition thereto, film 18 is protected from accidental engagement such as by the operator, which accidental engagement, even though slight, is often sufficient to nick and prematurely split or tear the film 18 during the wrapping operation.

The supply roll embodiment 12' of FIG. 2 is substantially identical to that shown in FIG. 1 except that the ends of cylinder 16 are substantially flush with the end of the web of film wrapped about the cylinder 16. For example, FIG. 2 shows end 16*a* ' substantially flush with end 18*a* of the web 18 of wrapping film. The embodiment in which the insert 14 has an enlarged brim-like flange 14*c* so as to incorporate flange portion 14*c*-1 shown in FIG. 5, is advantageous for use with the supply roll embodiment 12' of FIG. 2 since end 18*a* is positioned closer to the operator's fingers and is more likely to engage the operator's fingers and cause an abrasive burn in the absence of insert 14. Conversely, the supply roll 12', in the absence of insert 14, is more likely to be engaged by the operator's fingers, as well as anything else in the region of end 18*d*, for that matter. Thus, insert 14 prevents accidental tearing or splitting of the film 18.

Numerous occasions arise during which the operator may decide to set the roll of film down in order to diver this attention to another matter. Since the working region is frequently a warehouse or other similar area whose cleanliness leaves a lot to be desired, it is extremely advantageous to stand the roll 12' up on one end to prevent the film 18 from being contaminated, without first removing the hand held unit. It is not possible to stand supply roll 12' on end when using the hand held units of the prior art, without first removing the hand held unit. However, a supply roll 12' of the wrapping film 18 may be stood up on either of its ends without removing the inserts 14, 14'. In addition thereto, flange 14*c* protects the end of the roll of film from engaging the ground and possibly being contaminated or from being prematurely split or cut. The supply roll 12 of FIG. 1 is also capable of being stood up on its end without removing inserts 14, 14'.

FIG. 6 shows the manner in which two inserts 14 and 14' may be nested, one inside the other, for stacking purposes so as to reduce the amount of space required for shipping and storage. Very simply, the closed end of insert 14' is inserted into the open end of insert 14 and is pressed downwardly until the inserts 14 and 14' occupy the positions shown in FIG. 6. Only two inserts 14, 14' have been shown in FIG. 6 for purposes of simplicity. However it should be understood that a greater number of inserts may be nested and stacked for shipping and storage purposes.

As was described hereinabove, the insert 14 is preferably produced through a vacuum forming method and has a wall thickness of the order of 10 to 70 thousandths, a preferred flange thickness of 35 to 45 thousandths and a preferred thickness of the order of 40 thousandths. The outer diameter of the side wall 14*b* may be of any size to accommodate supply rolls having different inner diameters. The supply rolls most commonly in use have cylinders whose inner diameters range typically from 1.5 inches to 3 inches, typical sizes for example being 1.5 inches, 2 inches, 2¼ inches, 2½ inches, 2¾ inches and 3 inches. The outer diameter of the insert 14 is substantially of equal value for each associated supply roll and will not impose undue frictional drag upon the cylinder 16 since insert 14 is quite yieldable due to its relatively thin gauge. In order to facilitate selection of an insert 14 of the proper size for a supply roll 12, from an inventory of a variety of different size inserts, the inserts are preferably color coded. For example, the 1½ inch insert may be orange; the 2 inch insert may be blue; the 2¼ inch insert may be green; and so forth. In addition, the size of the insert may also be imbedded directly into the insert for example on the flange portion, so that a 2 inch insert may have the indicia '2" Insert' as shown for example in FIG. 3*b*, to facilitate selection of the proper size insert.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An insert arranged to be held by the hand of an operator for use in dispensing a web from a supply roll, said web being a web of wrapping film wrapped about a core comprising a hollow cylinder, said insert comprising:

a substantially cylindrical side wall having a first and second end and tapering slightly from said second end towards said first end so that said second end is wider than said first end, the hollow interior of said side wall being of a depth sufficient to receive the fingers of the operator when in use;

an end surface integral with said first end for substantially closing said side wall at said first end;

a substantially flat annular shaped flange having its inner periphery integrally joined to the second end of said side wall, which second end is open;

said insert being inserted into at least one end of said cylinder with said flange overlying at least the adjacent end of said cylinder, said insert being formed of a plastic material having a low coefficient of sliding friction, the surface of said insert engaging said cylinder being smooth, whereby said insert is freely slidable relative to said cylinder; the thickness of the insert being selected to significantly reduce the weight of the insert and enable the insert to be quite yieldable to facilitate insertion into the cylinder.

2. The apparatus of claim 1 wherein said insert is provided with spacing means engaging the interior periphery of said cylinder for reducing the surface engagement between said side wall and the interior periphery of said cylinder to thereby further enhance the sliding movement between said insert and said cylinder.

3. The apparatus of claim 2 wherein said spacing means comprises projections integrally formed in said side wall at spaced intervals thereabout and extending outwardly therefrom, the exterior surfaces of said projections being rounded to enhance the sliding movement between said insert and said cylinder.

4. The apparatus of claim 3 wherein said projections are elongated projections and extend parallel to the longitudinal axis of said side wall.

5. The apparatus of claim 4 wherein said projections form recesses at spaced intervals along the inner periphery of said side wall.

6. The apparatus of claim 1 wherein said insert further comprises gripping means provided in the interior surface of said sidewall to facilitate gripping of said insert.

7. The apparatus of claim 6 wherein said gripping means comprises projections integrally formed in said side wall and extending radially inward therefrom.

8. The apparatus of claim 7 wherein said inwardly extending projections are elongated projections and extend substantially parallel to the longitudinal axis of said side wall.

9. The apparatus of claim 8 wherein said inwardly extending projections form recesses at spaced intervals along the exterior surface of said side wall.

10. The apparatus of claim 1 wherein said insert is provided with spacing means for maintaining said flange a closely spaced distance from the adjacent end of said supply roll.

11. The apparatus of claim 10 wherein said spacing means further comprises a curved joining portion extending between the open end of said side wall and the inner periphery of said flange and being integral with said side wall and said flange;

the exterior surface of said curved portion engaging said cylinder when pressed into one open end thereof to maintain said annular flange a closely spaced distance from the adjacent end of said supply roll to prevent said flange from engaging said adjacent end of said supply roll while said flange protects said adjacent end of said supply roll from contamination when inserted into one open end thereof.

12. The apparatus of claim 11 wherein said flange is substantially flat to support a supply roll so that the supply roll may be stood on one end thereof with said insert resting upon the supporting surface to thereby permit the supply roll to be stood on end while preventing the end of the supply roll adjacent to the supporting surface from engaging the surface supporting the supply roll.

13. The apparatus of claim 1 wherein said insert is formed of styrene.

14. The apparatus of claim 1 wherein said insert is formed of a plastic material and has a thickness in the range from 10 to 70 thousandths inches.

15. The apparatus of claim 14 wherein the thickness of said insert is preferably in the range from 35 to 45 thousandths inches.

16. The apparatus of claim 1 wherein indicia representing the outer diameter of the side wall portion of said insert is imprinted in said insert to facilitate its selection.

17. The apparatus of claim 1 wherein the outer periphery of said flange extends over at least a portion of the end of the wrapping film wrapped about the cylinder of said supply roll to protect the wrapping film from being contaminated or accidently cut or split.

18. The apparatus of claim 1 wherein said insert is formed of rubber modified styrene.

* * * * *

UNITED STATES PATENT AND TRADEMARK OFFICE

CERTIFICATE OF CORRECTION

PATENT NO. : 4,372,500

DATED : February 8, 1983

INVENTOR(S) : Alfred Saraisky

It is certified that error appears in the above—identified patent and that said Letters Patent is hereby corrected as shown below:

Column 6, line 14, change "diver" to --divert--, and on line 15 change "this" to --his--.

Signed and Sealed this

*Twenty-third* Day of *August 1983*

[SEAL]

*Attest:*

GERALD J. MOSSINGHOFF

*Attesting Officer*

*Commissioner of Patents and Trademarks*